US007824764B2

(12) United States Patent
Berndt et al.

(10) Patent No.: US 7,824,764 B2
(45) Date of Patent: Nov. 2, 2010

(54) ANTIMICROBIAL STRANDS, THEIR PRODUCTION AND THEIR USE

(75) Inventors: Kurt-Günter Berndt, Graben (DE); Rex Delker, Wehringen (DE)

(73) Assignee: Teijin Monofilament Germany GmbH, Bobingen (DE)

( * ) Notice: Subject to any disclaimer, the term of this patent is extended or adjusted under 35 U.S.C. 154(b) by 170 days.

(21) Appl. No.: 12/070,797

(22) Filed: Feb. 21, 2008

(65) Prior Publication Data

US 2008/0220680 A1 Sep. 11, 2008

(30) Foreign Application Priority Data

Mar. 7, 2007 (DE) ..... 10 2007 011 076

(51) Int. Cl.
*B32B 13/02* (2006.01)

(52) U.S. Cl. ..... 428/294.7; 525/191; 442/341; 264/171.24; 524/341

(58) Field of Classification Search ..... 428/364, 428/373, 394, 294.7; 525/191; 442/181; 524/341; 264/171.24
See application file for complete search history.

(56) References Cited

U.S. PATENT DOCUMENTS

| | | | | |
|---|---|---|---|---|
| 2,972,600 | A * | 2/1961 | Braidwood | 528/129 |
| 3,287,440 | A * | 11/1966 | Giller | 525/139 |
| 6,299,651 | B1 | 10/2001 | Li | 8/115.64 |
| 6,451,915 | B1 * | 9/2002 | Ellul et al. | 525/191 |
| 6,939,918 | B2 * | 9/2005 | Ellul et al. | 525/191 |
| 7,326,740 | B2 * | 2/2008 | Stadler et al. | 523/122 |
| 2002/0128390 | A1 * | 9/2002 | Ellul et al. | 525/191 |
| 2003/0013813 | A1 * | 1/2003 | Ellul et al. | 525/191 |
| 2003/0125454 | A1 * | 7/2003 | Ellul et al. | 524/515 |
| 2004/0235983 | A1 * | 11/2004 | Stadler et al. | 523/122 |
| 2008/0220680 | A1 * | 9/2008 | Berndt et al. | 442/181 |
| 2008/0300339 | A1 * | 12/2008 | Wright et al. | 522/154 |

FOREIGN PATENT DOCUMENTS

| | | |
|---|---|---|
| CA | 2 551 701 | 12/2006 |
| DE | 689 09 268 T2 | 4/1994 |
| DE | 699 08 910 T2 | 5/2004 |
| WO | WO 97/32613 | 9/1997 |

OTHER PUBLICATIONS

Textilien und Fasern mit antibakterieller Ausrüstung, Referat in Warenkunde, Tina Wlodkowski, TBW 2, Münchberg, den May 31, 2001.

* cited by examiner

*Primary Examiner*—N. Edwards
(74) *Attorney, Agent, or Firm*—Michael W. Ferrell

(57) ABSTRACT

Described are antimicrobial strands comprising a) thermoplastic elastomer, b) polymer having a melting point of at least 10° C. below the melting point of the thermoplastic elastomer and c) halogenated phenol.

These strands are notable for an excellent antimicrobial effect, which survives repeated washing.

13 Claims, No Drawings

ANTIMICROBIAL STRANDS, THEIR PRODUCTION AND THEIR USE

CLAIM FOR PRIORITY

This application is based upon German Patent Application No. DE 10 2007 011 076.8, entitled "Antimikrobiell ausgerüstete Fäden, Verfahren zu deren Herstellung und deren Verwendung", filed Mar. 7, 2007. The priority of German Patent Application No. DE 10 2007 011 076.8 is hereby claimed and its disclosure incorporated herein by reference.

TECHNICAL FIELD

The present invention concerns elastic strands, in particular monofilaments, having an excellent antimicrobial effect. They are especially useful for producing textile fabrics used in fields demanding asepsis and sterility as well as elastic behavior.

BACKGROUND

Strands are typically rendered antimicrobial by doping with heavy metal ions, such as silver ions, or by applying antimicrobially active sizes to the strand surface. Attempts have also already been made to incorporate antimicrobially active substances in the strand, but this is generally limited to selected materials and the active substances are comparatively rapidly removed from the strand by washing.

Halogenated phenols are known as useful antimicrobial agents. One example is triclosan, 2-hydroxy-4,2',4'-trichlorodiphenyl ether.

Examples of antimicrobial strands are to be found in CA-A-2,551,701, which describes a microbiocidally active air filter comprising microbiocidal strands. Triclosan is one example of an antibacterial agent mentioned; polyvinyl chloride is proposed as strand-forming material.

DE-T-699 08 910 describes antimicrobial strands or textiles. The antimicrobial property is imparted by surficial application of triclosan or a derivative thereof to the strand or textile surface. It is stated in the description that the coextrusion of triclosan with strand-forming materials is only possible with selected polymers and does not work with polyester textiles, polyamide textiles, cotton textiles and lycra textiles.

U.S. Pat. No. 6,299,651 discloses textiles finished with etherified triclosan derivatives. The active substance is applied by contacting with the surface of the strand or textile at a temperature sufficient to effectuate diffusion into the strand or textile.

DE-T-689 09 268 describes a method of altering the surface of a solid synthetic polymer wherein a surface is contacted with a basic swelling agent. The altered surface can be used to introduce active substances into the synthetic polymer.

We have now surprisingly found a selected group of spinnable polymers which permit the introduction of large amounts of halogenated phenols and which permit the production of elastic strands having a hitherto unavailable performance profile. It has emerged that spinning thermoplastic elastomers with halophenols in the form of a masterbatch gives such strands.

SUMMARY OF INVENTION

It is an object of the present invention to provide elastic and antimicrobial strands and textiles which retain their antimicrobial effect after repeated washing.

The present invention provides a strand comprising a) thermoplastic elastomer, b) polymer having a melting point of at least 10° C. below the melting point of the thermoplastic elastomer and c) halogenated phenol.

DETAILED DESCRIPTION

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art. Terminology used herein is given its ordinary meaning consistent with the exemplary definitions set forth immediately below.

The term "strands" herein is to be understood as referring very generally to fibers of finite length (staple fibers), fibers of infinite length (filaments) and also multifilaments composed thereof, or yarns secondarily spun from staple fibers. Preference is given to melt-spun strands in the form of monofilaments.

"Monofilaments" herein are individual strands. Their diameter is typically in the range from 55 to 5000 μm and preferably in the range from 100 to 300 μm.

The thermoplastic elastomers of component a) may comprise a wide variety of types. Such polymers are typically elastomeric block copolymers and are known to one skilled in the art.

Examples of components a) are thermoplastic and elastomeric polyurethanes (TPE-Us), thermoplastic and elastomeric polyesters (TPE-Es), thermoplastic and elastomeric polyamides (TPE-As), thermoplastic and elastomeric polyolefins (TPE-Os) and thermoplastic and elastomeric styrene block copolymers (TPE-Ss).

The thermoplastic and elastomeric block copolymers a) may be constructed from a wide variety of different monomer combinations. The blocks in question generally comprise so-called hard and soft segments. Soft segments are typically derived from polyalkylene glycol ethers in the case of the TPE-Us, the TPE-Es and the TPE-As. Hard segments are typically derived from short-chain diols or diamines in the case of the TPE-Us, the TPE-Es and the TPE-As. As well as from diols or diamines, the hard and soft segments are constructed from aliphatic, cycloaliphatic and/or aromatic dicarboxylic acids or diisocyanates.

Examples of thermoplastic polyolefins are block copolymers comprising blocks of ethylene-propylene-butadiene and of polypropylene (EPDM/PP) or of nitrile-butadiene and of polypropylene (NBR/PP).

Particularly preferred components a) are thermoplastic and elastomeric polyurethanes and, in particular, thermoplastic and elastomeric polyether esters. Examples thereof are block copolymers comprising blocks of polyethylene terephthalate and/or of polybutylene terephthalate and also blocks of polyalkylene glycol terephthalate; or the blocks derived from aromatic and/or cycloaliphatic diisocyanate and alkylene- and/or arylenediamine and also blocks derived from aromatic and/or cycloaliphatic diisocyanate and α,ω-diaminopolyalkylene ether.

Thermoplastic and elastomeric polymers herein are block copolymers which have a similar room temperature behavior to conventional elastomers, but are plastically deformable on heating and thus exhibit thermoplastic behavior. These thermoplastic and elastomeric block copolymers have subregions with physical points of crosslinking (for example, secondary valency forces or crystallites) which become unlinked on heating without the polymer molecules decomposing.

Component b) comprises selected polymers. Concerned is the polymer component of the masterbatch used in the production of the strands of the present invention. To ensure sufficient spinnability and miscibility in the extruder, the melting point of the polymer of component b) should be at least 10° C. below the melting point of the polymer of component a).

Examples of suitable polymers of component b) are polyesters, polycarbonates, polyamides or, in particular, polyolefins.

Component b) may preferably be polyethylene terephthalate, polypropylene terephthalate, polybutylene terephthalate, polybutylene naphthalate, polyethylene naphthalate, thermoplastic and elastomeric polyether esters (TPE-Es) other than component a), polycarbonate, aliphatic polyamides, such as nylon-6 or nylon-6,6, and also, in particular, halogen-free polyolefins.

Preference for use as component b) is given to such polymers whose melting point is in the range from 140 to 220° C.

Particular preference is given to using polybutylene terephthalate and polyethylene and also very particularly polypropylene as component b).

Component c) comprises halogenated phenols. The phenols in question may have one or more rings. The phenols in question may have one or more phenolic hydroxyl groups. Useful halogen substituents include fluorine, chlorine, bromine and iodine; of these, bromine and especially chlorine are particularly preferred.

Very particular preference is given to phenols comprising a diphenyl ether core structure, in particular those types having one phenolic hydroxyl group and two to four halogen substituents; most preferably those types having a phenolic hydroxyl group ortho to the ether oxygen.

2-Hydroxy-4,2',4'-trichlorodiphenyl ether (triclosan) is a very particularly preferred component c).

The amounts of components a), b) and c) in the strands of the present invention can be chosen within wide limits. The strands typically contain 20% to 99.89% by weight of component a), 0.01% to 55% by weight of component b) and 0.1% to 25% by weight of component c), all based on the total mass of the strand.

The components a), b) and c) required for producing the strands of the present invention are known per se, partly commercially available or obtainable by processes known per se.

The strands of the present invention, as well as components a), b) and c), may further comprise further, adjunct materials d).

Examples thereof include hydrolysis stabilizers, processing aids, antioxidants, plasticizers, lubricants, pigments, delusterants, viscosity modifiers, crystallization accelerants or dyes.

Examples of hydrolysis stabilizers are carbodiimides.

Examples of processing aids are siloxanes, waxes or comparatively long-chain carboxylic acids or their salts, aliphatic, aromatic esters or ethers.

Examples of antioxidants are phosphorus compounds, such as phosphoric esters or sterically hindered phenols.

Examples of pigments or delusterants are organic dye pigments or titanium dioxide.

Examples of viscosity modifiers are polybasic carboxylic acids and their esters or polyhydric alcohols.

The proportion of adjunct materials d) can be up to 20% by weight of the total mass of the strand.

The strands of the present invention are preferably monofilaments.

The linear density of the strands of the present invention can vary within wide limits. Examples thereof are 30 to 45 000 dtex and more preferably between 100 and 1000 dtex.

The cross-sectional shape of the strands of the present invention is freely choosable, examples being round, oval or n-gonal, where n is not less than 3.

Very particular preference is given to monofilaments having a round or n-gonal cross section whose linear density is between 30 and 45 000 dtex; more particularly, these monofilaments contain at least one dye used in medically sterile areas.

The strands of the present invention are obtainable by processes known per se.

A typical production process comprises the measures of: i) mixing component a) and a masterbatch comprising components b) and c) in an extruder, ii) extruding the mixture comprising components a), b) and c) through a spinneret die, iii) withdrawing the filament formed, iv) optionally drawing and/or relaxing the filament formed and v) winding the filament formed.

The strands of the present invention may be produced using conventional melt-spinning processes combined with single or multiple drawing and, if appropriate, setting of the strands obtained.

The strands of the present invention are notable for a particularly good combination of elasticity and durable antimicrobial properties.

It is surprising to a person skilled in the art that the halogenated phenol combined with a polymer in the form of a masterbatch are readily incorporated and mixed into the thermoplastic elastomer. The masterbatch does not form agglomerates in the polymer matrix in that the material becomes finely dispersed. When chemically different polymers are mixed, the added polymer will often form islands in the matrix of the base polymer. This is evident from the large diameter fluctuations of the strand or from numerous thick places. These negative phenomena were surprisingly not observed here.

The strands of the present invention are preferably used for producing textile fabrics, in particular woven fabrics, laid fabrics, loop-formingly knit fabrics, braided fabrics or loop-drawingly knit fabrics.

The textile fabrics are preferably used in fields where asepsis and sterility are required.

A particularly noteworthy fact is that the antimicrobial property is permanently associated with the article of manufacture, since the masterbatch is uniformly dispersed throughout the cross section of the strand. This property survives repeated washing without any need for any afterfinishing.

Examples of uses of the strands of the present invention are the use in mattresses which are preferably to be used in hospitals, old people's homes and care homes, in upholstery covers, as for invalid chairs, in treadmills, in elastic straps used particularly in the fitness sector in keep-fit equipment and also in sun beds, in belt conveyors, in particular for hygiene and cosmetic articles, in filter cloths, in particular for rotary filters, such as compartment filter presses, or in textiles for the interior decoration of buildings or vehicles, in particular for the interior decoration of automobiles or airplanes or as seat covers or seat supports for office or school furniture.

Textile fabrics comprising the strands of the present invention likewise form part of the subject matter of this invention.

The present invention also concerns the use of the disclosed strands for the purposes indicated above.

The examples which follow elucidate the invention without limiting it.

EXAMPLES 1 AND 2 AND COMPARATIVE EXAMPLE

A thermoplastic, elastomeric polyether ester ("TPE-E") (Heraflex, Riteflex) and also a masterbatch (Sanitized MB P-96-61) containing 20% by weight of triclosan and polypropylene were used.

The TPE-E was admixed with 1.0% by weight (Example 1) or 1.5% by weight (Example 2) of the masterbatch immediately before the intake zone of an extruder. After extrusion, the polymer was melt spun via a spin head, the individual filaments were quenched in a water bath and subsequently multiply drawn in three stages, each of which was heatable, heat set, afterfinished and each filament individually wound up. The process data and the textile values obtained for the monofilaments are recited in the table which follows.

A monofilament without addition of masterbatch was co-spun for comparison.

The samples were tested in a Sanitized AG lab in accordance with the method SN 195 920 *Staphylococcus aureus* ATCC 6538. It was found that even sample 1 allowed no bacterial growth and had a good effect, unlike the untreated standard.

TABLE 1

Composition and Antibacterial Properties

| Example No. | Masterbatch quantity | Growth | Antibacterial effect |
|---|---|---|---|
| 1 | 1% | none | good |
| 2 | 1.5% | none | good |
| Comparison | 0% | moderate | insufficient |

While the invention has been described in connection with several examples, modifications to those examples within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary.

What is claimed is:

1. A strand comprising a) thermoplastic elastomer, b) polymer having a melting point of at least 10° C. below the melting point of the thermoplastic elastomer and c) a halo-ortho-hydroxydiphenyl ether.

2. The strand according to claim 1, wherein component a) is a thermoplastic polyurethane elastomer, a thermoplastic polyester elastomer, a thermoplastic styrene block copolymer or a combination of two or more thereof.

3. The strand according to claim 1, wherein component b) is a polyester, polycarbonate, polyamide or polyolefin.

4. The strand according to claim 3, wherein component b) is chosen from the group consisting of: polyethylene terephthalate, polypropylene terephthalate, polybutylene terephthalate, polybutylene naphthalate, polyethylene naphthalate, thermoplastic and elastomeric polyether ester other than component a), polycarbonate, aliphatic polyamide and also halogen-free polyolefin.

5. The strand according to claim 4 wherein the halogen-free polyolefin is polypropylene.

6. The strand according to claim 1, wherein the halo-ortho-hydroxydiphenyl ether is 2-hydroxy-4,2',4"-trichlorodiphenyl ether.

7. The strand according to claim 1, being a monofilament.

8. The strand according to claim 7, wherein the monofilament has a round or n-gonal cross section and a linear density between 0.5 and 25,000 dtex.

9. The strand according to claim 8, wherein the monofilament contains at least one dye approved by the FDA for use in medical devices and uniforms.

10. The strand according to claim 1, containing 20% to 99.89% by weight of component a), 0.01% to 55% by weight of component b) and 0.1% to 25% by weight of component c), all based on the total mass of the strand.

11. A process for producing the strand according to claim 1, comprising the measures of:

i) mixing component a) and a masterbatch comprising components b) and c) in an extruder, ii) extruding the mixture comprising components a), b) and c) through a spinneret die, iii) withdrawing the filament formed, iv) optionally drawing and/or relaxing the filament formed, and v) winding the filament formed.

12. A textile fabric comprising strands according to claim 1.

13. The textile fabric according to claim 12, comprising a woven fabric, a knit fabric, a braided fabric or a laid fabric.

* * * * *